United States Patent [19]

Kennedy et al.

[11] Patent Number: 4,529,389

[45] Date of Patent: Jul. 16, 1985

[54] WRIST-BORNE LAUNCHER FOR TOY VEHICLE HAVING FLYWHEEL MOTOR

[75] Inventors: Melvin R. Kennedy, New York, N.Y.; Dietmar Nagel, Chester, N.J.; Abraham A. Arad, Westport, Conn.

[73] Assignee: Buddy L Corporation, New York, N.Y.

[21] Appl. No.: 624,725

[22] Filed: Jun. 26, 1984

[51] Int. Cl.[3] ..... A63H 33/00

[52] U.S. Cl. ..... 446/26; 446/429

[58] Field of Search ..... 446/26, 429, 462, 463, 446/464, 457

[56] References Cited

U.S. PATENT DOCUMENTS

| | | | |
|---|---|---|---|
| 2,788,613 | 4/1957 | Gelfand et al. | 446/429 |
| 3,803,756 | 4/1974 | Strongin | 446/429 |
| 3,949,517 | 4/1976 | Reiner et al. | 446/26 |

*Primary Examiner*—Mickey Yu

*Attorney, Agent, or Firm*—Michael Ebert

[57] ABSTRACT

A wrist-borne launcher for a toy vehicle having a road-engaging flywheel mounted on an axle, one end of which extends through the bearing of a false wheel and terminates in a male coupler coaxial with a ring on the outer hub thereof. When not in use, the vehicle is held on a platform having a battery compartment, the platform being provided at its underside with a wrist-engaging cuff. Wires from the battery compartment pass through an arm cantilevered from the platform to reach over the hand of the player. The wires are connected to an electric motor housed in a power box supported at the free end of the arm, a depressible switch being connected in series with the motor. The shaft of the motor terminates in a female coupler coaxially disposed within a cylindrical socket formed in the side of the box corresponding to the underside of the platform, a switch actuator being interposed between the female coupler and the rim of the socket. When the player removes the vehicle from the platform and pushes the false wheel against the power box so as to telescope the hub ring within the socket, the male coupler then engages the female coupler and the ring depresses the switch actuator to activate the motor, thereby driving the flywheel. When the flywheel is revved up, the player then releases the vehicle onto a road surface to permit the vehicle to speed away from the launcher.

10 Claims, 8 Drawing Figures

WRIST-BORNE LAUNCHER FOR TOY VEHICLE HAVING FLYWHEEL MOTOR

BACKGROUND OF INVENTION

Field of Invention

This invention relates generally to wrist-borne launchers for toy vehicles, and more particularly to a launcher for a vehicle having a road-engaging flywheel which is revved up on the launcher area by means of an electric motor whereby the flywheel, when the vehicle is thereafter released by the player, functions to drive the vehicle.

Many toy vehicles are provided with a spring motor which when wound up, acts to store energy. The spring motor is operatively coupled through a gear train to a set of wheels on the vehicle which are driven as the spring unwinds.

In order to obviate the need for a spring motor and a winding operation, it is known to make use of a flywheel as the vehicle motor. Because of its relatively heavy mass and inertia, the flywheel serves to store motive energy. To exploit the inertia characteristic of a flywheel, the typical vehicle of this type is provided with a retractable pull-out string operatively coupled to the flywheel. When the string is pulled out by the player and the flywheel thereby set into motion, the axle of the flywheel then engages a gear train to drive a set of wheels on the vehicle. Whether using a flywheel or a spring-wound motor, conventional toy vehicles also incorporate gear trains and clutches, and are therefore relatively complex and expensive to manufacture.

Also known are toy vehicles which include a miniature electric motor and a battery compartment as well as switches. When the motor is activated, it drives a set of wheels through a gear train. Because such electrically powered vehicles are comparatively heavy, the motor therefor must be capable of operating under heavy load conditions, and this adds significantly to the cost of the vehicle.

In recent years, toy vehicle launchers have been developed in which the launcher is strapped or otherwise attached to the wrist of the player so that the player can then, by pointing his hand, determine the direction of vehicle travel when the vehicle is released. The vehicle, itself, in the typical launcher, is without any motor. But the launcher includes a spring-operated catapult which when unlatched by the player hurls the vehicle forward. This has limited play value; for once released, the vehicle, which has no motor, can only travel a short distance.

SUMMARY OF INVENTION

The main object of this invention is to provide a wrist-borne launcher for a toy vehicle having a flywheel motor, the launcher including means to rev up the flywheel before the vehicle is released by the player so that the released vehicle is capable of travelling a relatively long distance on a road surface.

More particularly, an object of this invention is to provide a toy vehicle for use in conjunction with a launcher of the above type, in which the flywheel motor also functions as the drive wheel for the vehicle, thereby obviating the need for a gear train intercoupling the flywheel and a wheel set and additional mechanical expedients which render the vehicle structure complex and costly.

Also an object of the invention is to provide a wrist-borne launcher assembly of the above type in which the launcher incorporates an electric motor and a battery compartment, the activated electric motor being coupled to the flywheel of the vehicle to rev it up.

A significant feature of the invention resides in the inclusion of a power gauge coupled to the shaft of the electric motor to indicate the point at which the flywheel is fully revved up and the vehicle is ready to be released.

Briefly stated, these objects are attained in a wrist-borne launcher for toy vehicle having a road-engaging flywheel mounted on an axle, one end of which extends through the bearing of a false wheel and terminates in a male coupler coaxial with a ring on the outer hub thereof. When not in use, the vehicle is held on a platform having a battery compartment, the platform being provided at its underside with a wrist-engaging cuff. Wires from the battery compartment pass through an arm cantilevered from the platform to reach over hand of the player. The wires are connected to an electric motor housed in a power box supported at the free end of the arm, a depressible switch being connected in series with the motor. The shaft of the motor terminates in a female coupler coaxially disposed within a cylindrical socket formed in the side of the box corresponding to the underside of the platform, a switch actuator being interposed between the female coupler and the rim of the socket. When the player removes the vehicle from the platform and pushes the false wheel against the power box so as to telescope the hub ring within the socket, the male coupler then engages the female coupler and the ring depresses the switch actuator to activate the motor, thereby driving the flywheel. When the flywheel is revved up, the player then releases the vehicle onto a road surface to permit the vehicle to speed away from the launcher.

OUTLINE OF DRAWINGS

For a better understanding of the invention as well as other objects and further features thereof, reference is made to the following detailed description to be read in conjunction with the accompanying drawings, wherein:

FIG. 6 is a perspective view of the DC motor;

DESCRIPTION OF INVENTION

Structure

Figure 8:
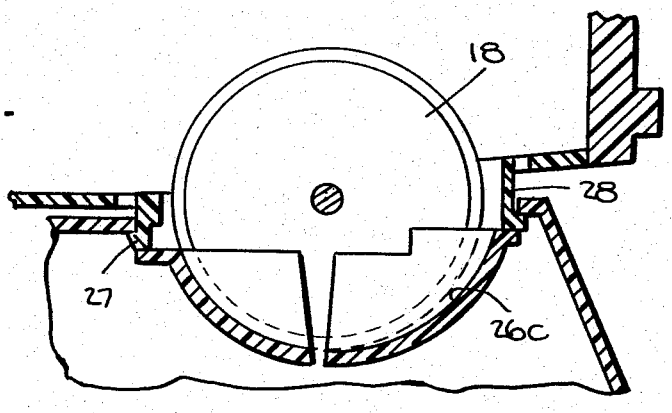
FIG. 8 is a section taken in the plane indicated by line 8—8 in FIG. 7.
Figure 1:
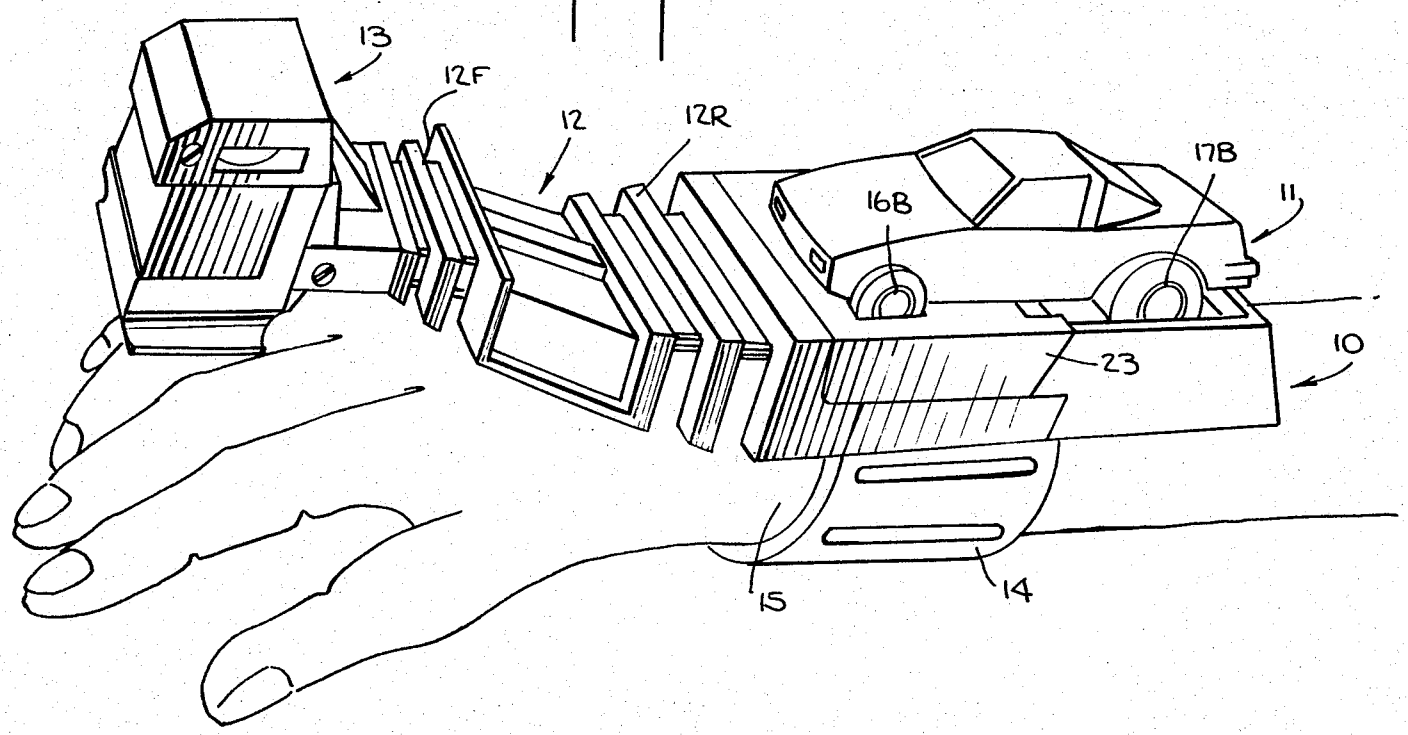
FIG. 1 is a perspective view of a wrist-borne launcher in accordance with the invention, the launcher being mounted on the wrist of a player and the vehicle being latched on the launcher platform.

Referring now to FIG. 1, there is shown a wrist-borne vehicle launcher in accordance with the invention, the major components of which are a platform 10 on which the vehicle 11 to be launched is latched when the vehicle is not in use, a cantilever arm 12 and a power box 13.

Platform 10 is provided at its underside with a cuff 14 formed by a pair of curved, flexible, flat pieces for embracing the wrist 15 of the player. Arm 12, which includes a wiring duct, is cantilevered from the front end of the platform to reach over the hand of the player, power box 13 being secured to the free end of the arm.

Vehicle 11, whose appearance may simulate that of a racing car or which may take the form of any other four-wheeled vehicle, is provided with a set of free-running front wheels 16A and 16B which engage a road surface, and a set of rear wheels 17A and 17B which are fixedly secured to the chassis and are therefore false or mock wheels. Interposed between false wheels 17A and 17B is a weighted flywheel 18 mounted on an axle 19 (see FIGS. 4 and 5) whose ends are received in the bearings of false wheels 17A and 17B.

Flywheel 18, which is made of metal and has a larger diameter than the diameter of the false wheels, is provided with a center tire 20 of elastomeric material, which tire engages the road surface after the vehicle is launched. Thus, in operation the vehicle rides on the front wheels and the single rear flywheel, though to all appearances it rides on four wheels.

The end of axle 19, which extends into the bearing of false wheel 17A, terminates in a male coupler 21 formed by four pins $21_p$ radiating outwardly from the coupler head at 90° angles from each other. Coupler 21 is coaxially disposed within a ring 22 protruding from the hub of false wheel 17A.

Figures 3, 7:
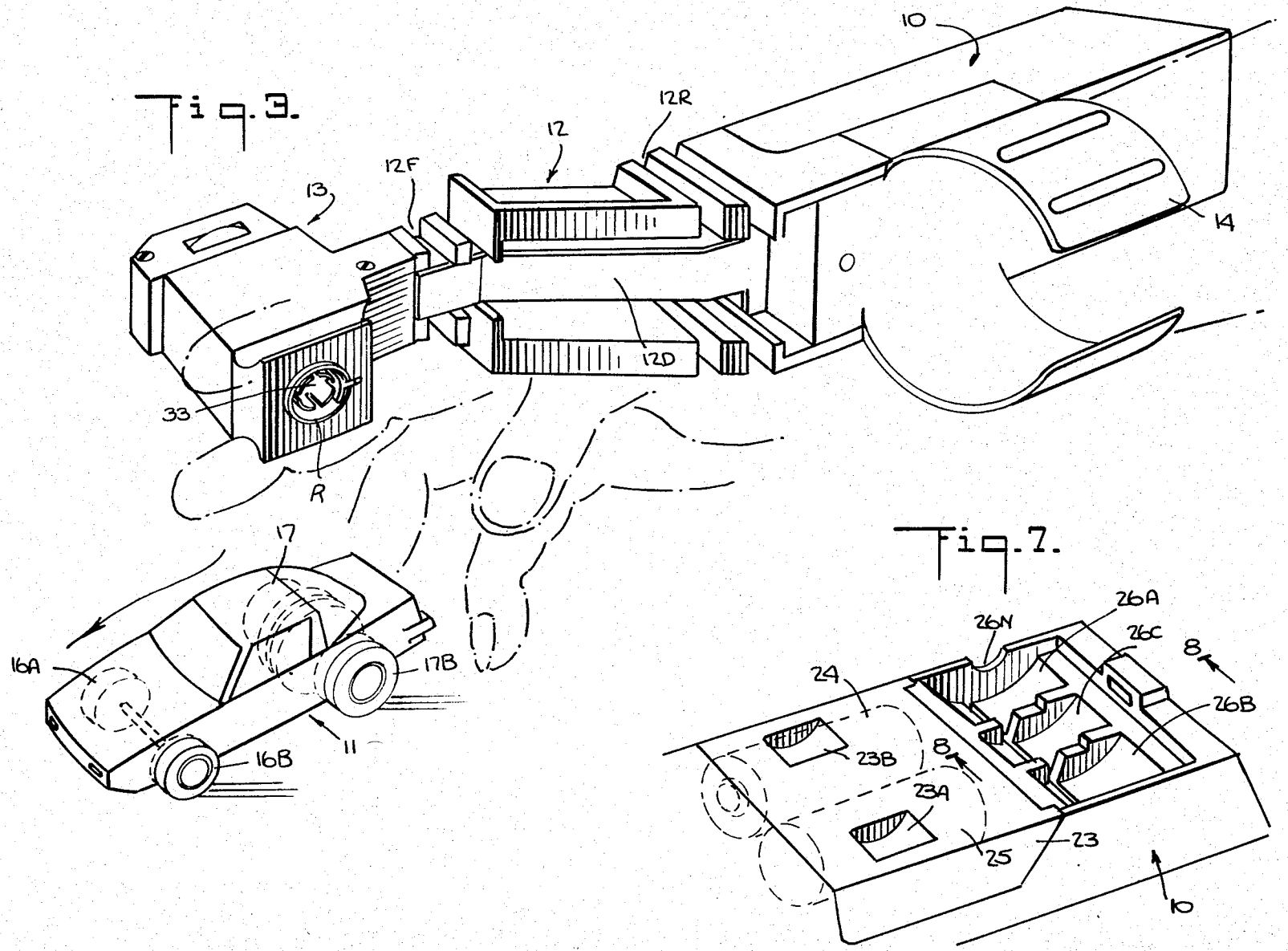
FIG. 3 shows the vehicle being released from the launcher by the player.
FIG. 7 illustrates, in perspective, the top side of the platform.

Platform 10 is provided at its top side with a battery compartment which includes a removable cover 23, as shown in FIGS. 1 and 7. A pair of cylindrical batteries 24 and 25 is stored in this compartment. The end poles of the batteries make contact with terminals (not shown) for connection to a DC motor.

Molded in cover 23 is a pair of spaced concave recesses 23A and 23B in which front wheels 16A and 16B of the vehicle are nested. At the rear of platform 10 is a like pair of recesses 26A and 26B in which false wheel 17A and 17B are nested, the side wall of recess 26A having a notch 26N therein to accommodate the male coupler 21 projecting from false wheel 17A.

Intermediate recesses 26A and 26B is a concave center recess 26C to accommodate flywheel 18. The forward end wall of 26C is engaged by a ridge 27 on the underside of the vehicle (see FIG. 4) adjacent the front of flywheel 18. The rear wall of recess 26C is engaged by flexible latching tab 28 adjacent the rear of the flywheel, so that the vehicle can be snapped into the flywheel recess and thereby detachably held on the platform until put to use by the player.

Figure 2:
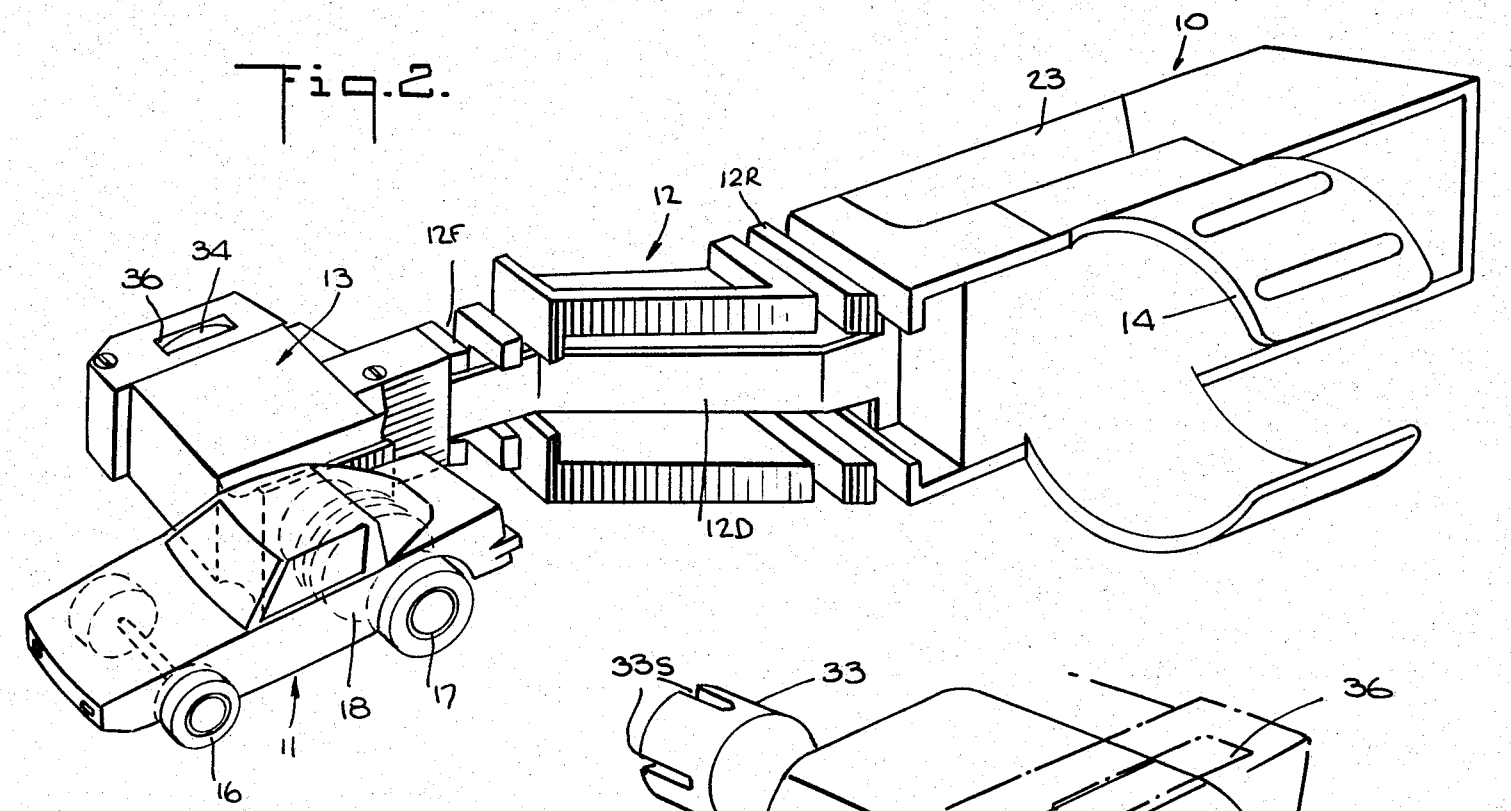
FIG. 2 is a perspective view showing the launcher when the unlatched vehicle is pressed by the player against the power box to rev up the flywheel.
Figure 4:
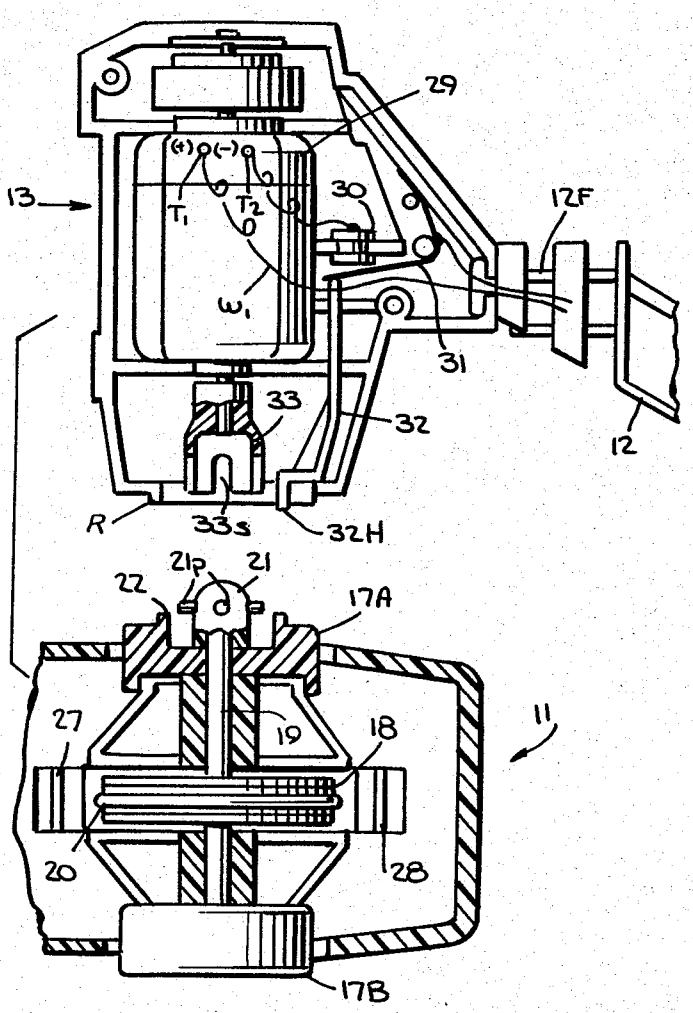
FIG. 4 is a longitudinal section taken through the power box and through the related portion of the vehicle when the vehicle is disengaged from the box.
Figure 5:
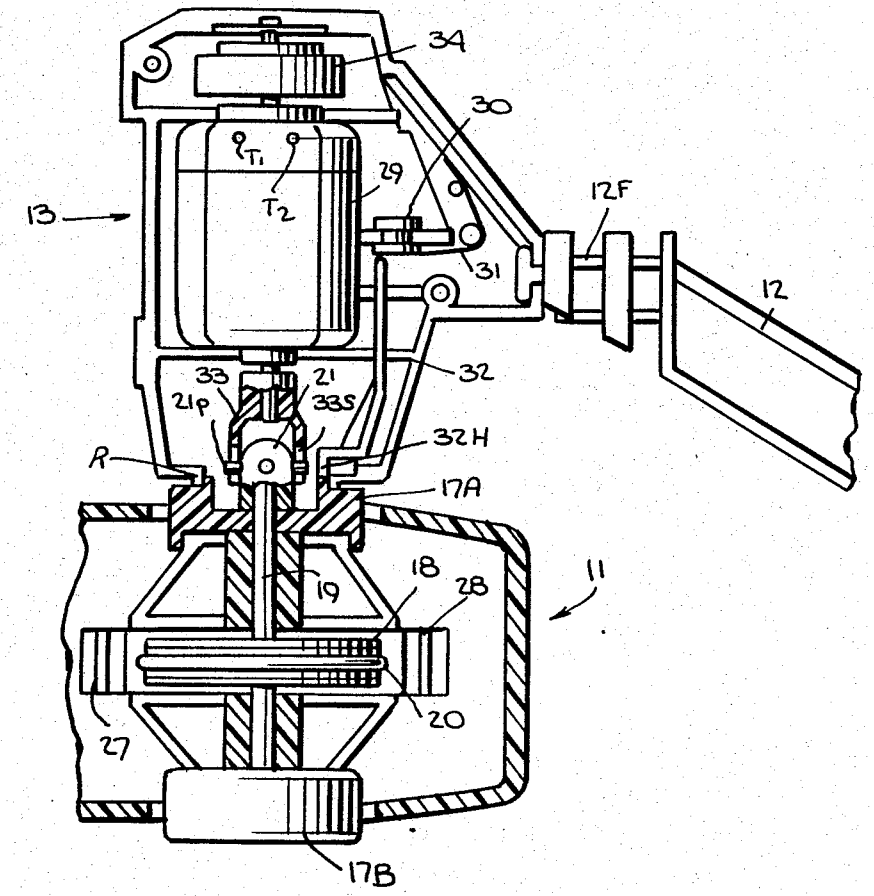

Power box 13, as best seen in FIG. 4, houses a miniature DC motor 29 which is energized by the batteries in the platform compartment through a normally-open depressible switch. This switch is defined by a fixed contact 30 and a flat spring contact 31 which, when a switch actuator 32 is depressed, engages fixed contact 30. The positive terminal $T_1$ of motor 29 is connected by a wire $W_1$ to the positive terminal in the battery compartment, wire $W_1$ running through a flat duct 12D extending along the length of arm 12 at the underside therof, as shown in FIG. 2. The arm is provided with flexible front and rear baffled sections 12F and 12R which permit the launcher to accommodate its form to the shape of the hand of the player.

The negative terminal $T_2$ (FIG. 4) of the motor is connected to fixed switch contact 30, the movable spring contact 31 being connected by a wire $W_2$ which passes through duct 12D of the cantilever arm 12 to the negative terminal in the battery compartment. Thus when the switch is depressed by its actuator 32, battery power is applied to energize motor 29.

One end of the shaft of motor 29 is secured to a female coupler 33. This coupler is coaxially disposed within a socket having a cylindrical outer rim R, this socket being formed in the end of power box 13 which corresponds to the underside of the platform. Female coupler 33 is in the form of a cylindrical cup having four slots 33S (see FIG. 6) at positions corresponding to the radial positions of pins $21_p$ on male coupler 21.

Interposed between female coupler 33 and rim R of the socket is the arcuate head 32H of the switch actuator 32, the curvature of this head conforming to the curvature of rim 34 and having a lateral fin which is received in a slot in the rim to maintain the position of the actuator.

Operation

Figure 5:
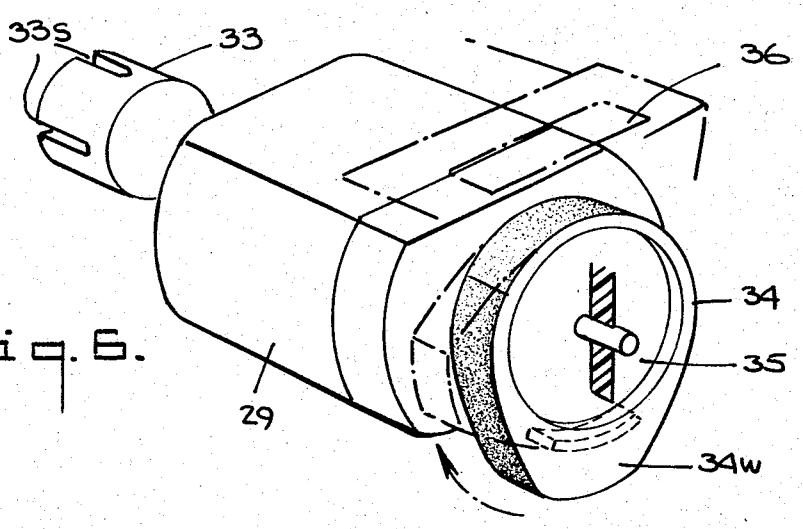
FIG. 5 is the same as FIG. 4, except that in this figure, the vehicle engages the power box.

When one wishes to play with the launcher, vehicle 11 is detached from platform 10 on which is normally latched, and the launcher is coupled by its cuff 14 to the wrist of the player who then holds the vehicle in his hand. The player, as shown in FIG. 5, presses the false wheel 17A of the vehicle against the power box 13 so that the ring 22 on the hub of the false wheel telescopes within the rim R of the socket containing female coupler 33.

In pushing in the hub ring, this causes male coupler 21 projecting from the hub to engage female coupler 33, the pins of the former nesting within the slots of the latter. At the same time, the pushed-in ring 22 engages the head 32H of the actuator to operate the switch and thereby apply battery power to motor 29.

As a consequence, the shaft of the energized motor is operatively coupled to flywheel 18 to set it into motion. In order to assure that the flywheel is adequately revved up before the vehicle is released from the hand of the player, a power gauge 34 is provided. Power gauge 34, as best seen in FIGS. 2 and 6, is disposed on the end of power box 13 opposite to the female coupler and it takes the form of a dollar having an eccentric weight 34W on one side thereof, the periphery of the gauge being visible through a window 36.

A drag wheel 35 mounted on the shaft of motor 29 operates within collar 34, and as a result of frictional contact therewith, acts to turn this collar from its normal or static position in which weight 34W is at the bottom to a position in which this weight is then visible through window 36.

By color coding the periphery of gauge collar 34, a power indication is provided. Thus the periphery may be colored green, except for the weighted portion 34W which is colored red. Hence when the motor coupled to the flywheel is operated for a brief period sufficient to cause a red power indication, this signals the player that it is time to release the vehicle.

The player, before releasing the vehicle, points the launching platform with his hand toward a road surface, such as a floor or table in his playroom. When the vehicle is released, it will race across this surface; for the stored energy in the flywheel is sufficient to provide extended travel for the released vehicle.

While there has been shown and described a preferred embodiment of a wrist-borne launcher for toy vehicle having flywheel motor in accordance with the invention, it will be appreciated that many changes and modifications may be made therein without, however, departing from the essential spirit thereof.

Thus in practice, there is no mechanical need for false wheels on the toy vehicle, and one may provide other configurations to hold the bearings for the flywheel axle, with a coupler attached to one end of this axle. Also, while in the embodiment shown, the coupler on the flywheel axle is a female element and that on the motor shaft is a male element, in practice this arrangement may be reversed; for all that is necessary for the coupler elements is to be complementary and to interengage.

We claim:

1. A wrist-borne launcher and vehicle assembly, said assembly comprising:

A. a vehicle having a road-engaging flywheel mounted on an axle, one end of which extends through the bearing of a false wheel and terminates in a projecting male coupler coaxial with a ring on the outer hub of the wheel; and B. a launcher provided with means to engage the wrist of the player and including a battery-operated electric motor housed in a power box, one end of the shaft of the motor being secured to a female coupler coaxial with the outer rim of a socket whereby when the false wheel of the vehicle is brought against the power box by the player with the ring telescoping within the rim, the male coupler then engages the female coupler to cause said motor to rev up the flywheel, after which the vehicle may be released by the player to travel along a road surface, said launcher further including a platform on which said vehicle is latched when it is not in use, said power box being supported at the end of an arm cantilevered from the front end of the platform.

2. An assembly as set forth in claim 1, wherein said vehicle has a set of free running front wheels and a set of fixed rear wheels acting as the bearings for the axle of the flywheel, one of which false wheels has said projecting male coupler.

3. An assembly as set forth in claim 1, wherein said platform includes a battery compartment having terminals connected by wires through a duct supported on said arm to said motor in the power box.

4. An assembly as set forth in claim 3, further including a depressible switch housed in said power box in series with said motor, said switch having an actuator whose head is interposed between the female coupler and the socket rim, whereby when the ring of the false wheel is telescoped in said rim to effect engagement of the couplers, the actuator is at the same time depressed to close the switch and energize the motor.

5. An assembly as set forth in claim 4, wherein said switch has a fixed contact and a spring contact which is brought into engagement with the fixed contact by said retractor.

6. An assembly as set forth in claim 1, wherein said male coupler is constituted by a set of pins radiating from the coupler and said female coupler is constituted by a cup having slots to receive said pins.

7. An assembly as set forth in claim 1, further including a power gauge operatively coupled to the shaft of the motor to indicate when the flywheel is revved up.

8. An assembly as set forth in claim 1, wherein said platform is provided with recesses to nest said front wheels, said false wheels and said flywheel.

9. An assembly as set forth in claim 1, wherein said means to engage the wrist is constituted by a cuff formed by a pair of complementary flexible curved pieces.

10. In combination with a vehicle provided with a false wheel having a bearing and a road-engaging flywheel mounted on an axle one end of which extends through said bearing and terminates in a projecting male coupler coaxial with a ring on the outer hub of the false wheel, means for revving up the flywheel comprising a battery-operated electric motor housed in a power box provided with a socket having an outer rim, the motor shaft being secured to a female coupler coaxial with the rim of the socket whereby when the false wheel of the vehicle is brought against the box by the player with the ring telescoping within the rim, the couplers are interengaged to cause the motor to drive the flywheel, and a depressible switch connected in series with said battery and said motor, said switch having an actuator whose head is interposed between the female coupler and the socket whereby when the ring of the false wheel is telescoped in said rim, the actuator is at the same time depressed to close the switch and energize the motor.

* * * * *